US005915355A

United States Patent [19]

Andreasson

[11] Patent Number: 5,915,355

[45] Date of Patent: Jun. 29, 1999

[54] COMPENSATING AIR REGULATING VALVE

[75] Inventor: Jan Andreasson, Mullsjö , Sweden

[73] Assignee: Aktiebolaget Electrolux, Stockholm, Sweden

[21] Appl. No.: 08/973,797

[22] PCT Filed: Jun. 7, 1996

[86] PCT No.: PCT/SE96/00754

§ 371 Date: Dec. 9, 1997

§ 102(e) Date: Dec. 9, 1997

[87] PCT Pub. No.: WO96/41941

PCT Pub. Date: Dec. 27, 1996

[30] Foreign Application Priority Data

Jun. 9, 1995 [SE] Sweden ..... 9502116

[51] Int. Cl.[6] ..... F02M 1/02; F02M 1/10

[52] U.S. Cl. ..... 123/336; 123/391; 123/400; 261/39.3; 261/39.4

[58] Field of Search ..... 123/198 D, 336, 123/337, 400, 391; 261/39.1, 39.3, 39.4, 52, 65

[56] References Cited

U.S. PATENT DOCUMENTS 2,548,334 4/1951 Armstrong ..... 261/39.1

4,031,872 6/1977 Thompson et al. ..... 261/39.3

4,123,480 10/1978 Johansson ..... 261/52

FOREIGN PATENT DOCUMENTS 2633546 12/1982 Germany .

OTHER PUBLICATIONS

Patent Abstracts of Japan, vol. 10, No. 349, M–538, Abstract of JP, A, 61–149553 (Hitachi Ltd.), Jul. 8, 1986.

*Primary Examiner*—Tony M. Argenbright

*Attorney, Agent, or Firm*—Pearne, Gordon, McCoy & Granger LLP

[57] ABSTRACT

Fuel supply system (1) for a combustion engine arranged in an inlet duct (2), which extends to the engine body itself. The system (1) comprises one or several air valves (5, 6), which are all mechanically connected with manually influenced linkages, such as a starting control, choke or throttle control linkages, as well as one or several nozzles (3, 4) located in connection with the air valves (5, 6). At least one air valve (5, 6) is influenced by a temperature sensitive device (10), so that the valve's (5, 6) angular position changes in at least one angular position, for instance an end position, by means of the valve or its linkage shaft (7, 8) being mechanically influenced by the temperature sensitive device, either directly or via an intermediate device.

7 Claims, 6 Drawing Sheets

COMPENSATING AIR REGULATING VALVE

TECHNICAL FIELD

The subject invention refers to a fuel supply system for an internal combustion engine arranged in an inlet duct, which extends to the engine body itself. The system comprises one or several air valves as well as one or several nozzles located in connection with the air valves.

BACKGROUND OF THE INVENTION

Carburetors for two-stroke or four-stroke engines are arranged in an inlet duct, which extends to the engine body itself. The carburetor often has two air valves, one throttle valve and one choke valve. The throttle valve is used for governing the inlet air flow while the choke valve is used for cold starts. The choke valve is then usually entirely closed, either manually or automatically. A small opening in the choke valve sees to that only a small amount of air passes the throttle valve in conjunction with the starting attempt. This results in a substantial underpressure in the inlet duct by the nozzles located downstreams. Thereby, a great amount of fuel is supplied and a very rich fuel mixture is obtained. This is necessary since a substantial amount of fuel condenses on the walls of the inlet duct, the crankcase and the combustion chamber under these conditions. There are also carburetors with only one air valve, which then functions as a throttle valve as well as a choke valve. Furthermore, there are fuel injection systems, which have a separate starting system comprising a choke valve and a starting nozzle, functioning in accordance with carburetor principles. The amount of fuel for starting is then substantially influenced by the underpressure from the choke valve.

The characteristic of these fuel supply systems is that, at cold start, an air valve, usually called a choke valve, is almost entirely closed, so that a substantial underpressure is formed downstreams the air valve. Often the choke valve closes entirely and a small opening or a small hole allows for the necessary bypassing of a small amount of air. The size of the small air opening is dimensioned according to the lowest starting temperature by which the product is usually used. For a chain saw this can for instance be −25 degrees C. This implies that at higher temperatures, e.g. +20 degrees C., the air opening is too small to give a correct air/fuel mixture for starting. This leads to an unnecessarily rich fuel mixture and to a more difficult or absent starting function. There is also a great risk that the engine stops immediately after start. Furthermore, the rich fuel mixture leads to an unnecessary soot formation in the engine and unnecessarily high exhaust emissions. For, when starting the product, the throttle control is pulled out entirely, since it is hardly possible to fine-adjust the control for optimum air opening in real life usage.

PURPOSE OF THE INVENTION

The purpose of the subject invention is to substantially reduce the above outlined problems.

SUMMARY OF THE INVENTION

The above purpose is achieved in a fuel supply system in accordance with the invention having the characteristics appearing from the appended claims.

The fuel supply system in accordance with the invention is thus essentially characterized in that at least one air valve is pivoted around its linkage shaft, and at least one spring device, for instance a torsion spring or a plate spring, is arranged so that it acts between the valve and its linkage shaft, and keeps the valve in a defined angular position in relation to the linkage shaft, and so that a force of a certain magnitude acting on the valve can turn the valve from the defined angular position, and a greater force results in a greater angular rotation. Hereby the air valve, usually a choke valve, gets an elastic mounting in relation to its linkage shaft in the turning direction, and a force of sufficient magnitude can turn the valve in relation to the linkage shaft. Owing to this, different types of compensation of the valve function are made possible. A maximum speed regulating function can be obtained by means of the rapidly passing airflow turning the valve at initial overspeeding, so that throttling of the air supply occurs. Furthermore, a temperature sensitive device, for instance a bimetal or a memory metal device, can be arranged so that it acts between the valve and its linkage shaft and results in a force acting on the valve. The force is temperature dependent and wants to turn the valve from its defined, normal, angular position. Thus, a temperature compensation of the valve function is obtained. The function of the choke valve can hereby be temperature compensated, so that the valve opens at higher temperatures even if the choke or starting control has been entirely pulled out. This makes the engine more easily started and easier to handle for the user, at the same time as the exhaust emissions are reduced. However, even during running conditions, i.e. when the choke or starting control is not activated, a temperature compensation can be obtained. One example is that the valve closes somewhat at very low temperatures in order to give a desirably richer mixture under these conditions. These and other characteristics and advantages will be more apparent from the detailed description of the preferred embodiment, with the support of the enclosed drawing figures.

DESCRIPTION OF THE DRAWING

The invention will be described in closer detail in the following by way of various embodiments thereof with reference to the accompanying drawing figures.

FIGS. 9 and 10 show a maximum speed regulating function. The choke valve in the preferred embodiment in accordance with FIGS. 9 and 10 is unsymmetrical in order to create this acting force in the case of a straight inlet duct, which is used here.

DESCRIPTION OF PREFERRED EMBODIMENTS

Figure 1:
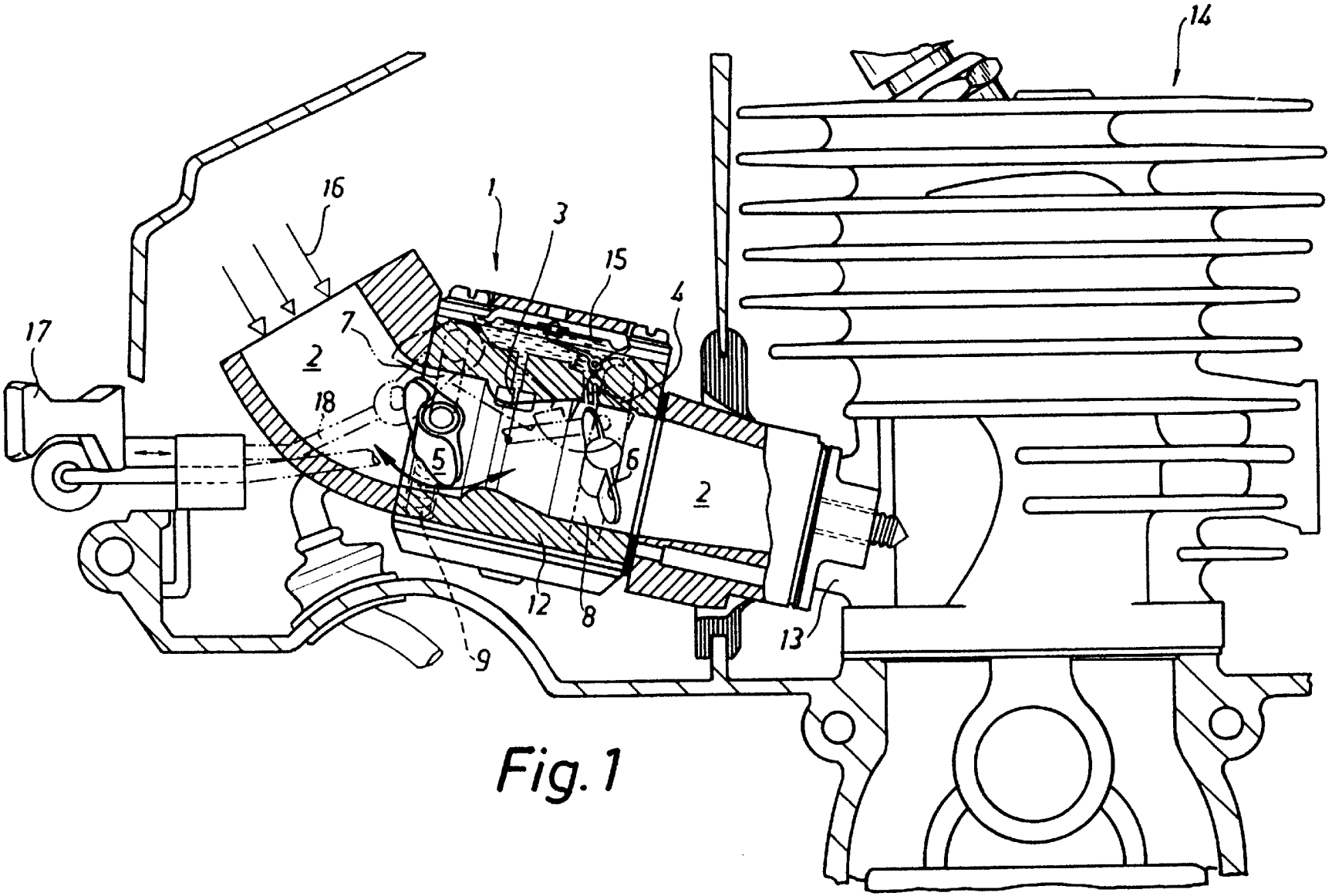
FIG. 1 shows a side view of the cylinder of an internal combustion engine with a carburetor connected in the inlet duct adjacent to the engine's inlet port. The carburetor as well as parts of the inlet duct are shown in cross section for the sake of clarity.

FIG. 1 shows a fuel supply system in accordance with the subject invention. It comprises a carburetor 12 arranged in an inlet duct 2. The fuel supply system is mounted to an inlet port 13 of the engine body 14. In this case the engine is a two-stroke engine, but also four-stroke engines and other types of combustion engines can come up for consideration, as long as they use a fuel supply system with air valves 5, 6. Thus, the system contains one or several air valves 5, 6, as well as one or several nozzles 3, 4, located in connection with the air valves. Nozzle 3 is a so called main jet, while nozzle 4, which here has three different inlets into the inlet duct 2, is a nozzle intended for idling and part throttle. The carburetor is a conventional so called diaphragm carburetor, where a fuel volume 15 is connected with the nozzles 3, 4. The carburetor design is in these respects entirely conventional and will not be further examined. Air 16 is drawn into the inlet duct 2 and fuel is supplied through the nozzles 3, 4. In this case the fuel supply system has two air valves, one choke valve 5 and one throttle valve 6, but other variants are also possible, for instance one single air valve. For the sake of clarity the throttles 5, 6 are not shown in cross section, while the remaining carburetor is shown in cross section. The choke valve 5 is designed in accordance with the invention and is pivoted around its linkage shaft 7. This linkage shaft as well as the throttle valve's linkage shaft lie largely in front of the illustration and are therefore shown with dash-dotted lines. This also applies to the levers, which operate each valve. These levers are more clearly illustrated in FIGS. 3 and 4. A starting control 17 is located on the outside of the engine, in this case a chain saw. When starting, the control 17 is pulled out whereby the linkage rod 18 influences the choke and throttle valves in a way that is further explained in connection with FIGS. 3 and 4. This means that the engine is choked in combination with activation of the throttle valve to its starting position. A spring device 9 is connected to the choke valve's linkage shaft. This will be more apparent from FIG. 2.

Figure 2:
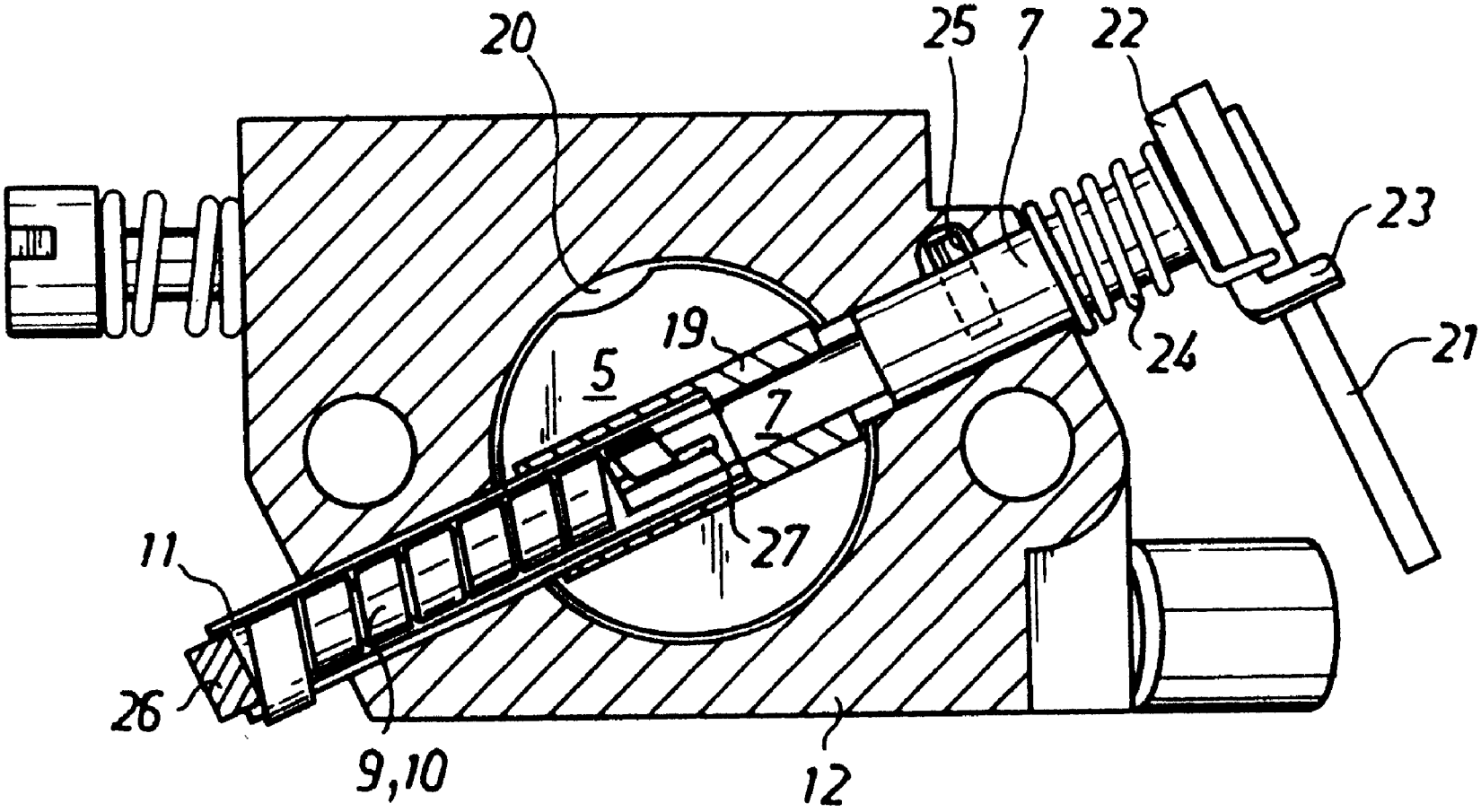
FIG. 2 shows, schematically and in cross section, the carburetor in FIG. 1, seen in the direction of the inflowing air. It is supplied with a compensating valve, in accordance with the subject invention.

Thus, FIG. 2 shows a cross section seen in a longitudinal direction, i.e. in the flow direction of the air through the carburetor in FIG. 1. The cross section is positioned at the compensated choke valve, in accordance with the invention. The choke valve has, in a conventional way, a throttle plate 5 with an opening 20, which also can consist of a hole. In a conventional carburetor the throttle plate 5 is directly mounted to a choke linkage shaft 7, which is turned by means of a choke valve lever 21. However, in this case the choke valve plate 5 is instead pivoted around its linkage shaft 7. This functions in such a way that a sleeve part 19 on the choke valve 5 is pivoted around the choke linkage shaft 7. The choke valve lever 21 is rotationally firmly mounted to the choke linkage shaft 7. In this case, there is a device for automatic latching of the throttle in its starting position. A latch lever 22 is therefore pivoted around the linkage shaft 7. The latch lever 22 is influenced by a return spring 24, which is pretensioned and wants to turn the latch lever in a counterclockwise direction seen from the latch lever's shaft end in the linkage shaft 7. A finger 23 transmits this return spring movement to the choke valve lever 21. The latch lever 22 cooperates with the throttle valve lever. This will be more apparent from FIGS. 3 and 4. In preferred embodiments where this function of automatic starting throttle activation is not used, the latch lever 22 with finger 23 and return spring 24 are consequently left out.

Thus, the characteristic of the invention is that the choke valve 5 is pivoted around the linkage shaft 7, here with a sleeve part 19, which turns lightly on the linkage shaft 7. The bearing is embodied on a thinner section of the linkage shaft 7 in order not to give the sleeve part 19 an unnecessarily large diameter, which would mean an unnecessary interruption of the flow in a non-choked position. The linkage shaft 7 is at its inner end supplied with a penetrating slit 27. This grips the torsion spring 9, so that the linkage shaft 7 thus turns the torsion spring 9. The torsion spring 9 is enclosed in a tubular transmission shaft 11, which in turn is pivoted in the carburetor 12. The torsion spring's 9 outer end is mounted in the tubular transmission shaft 11, suitably by means of a slit in the shaft 11. The tubular transmission shaft 11 is pressed into the sleeve part 19, with such a hard grip that no turning occurs during normal running of the engine. On the other hand, a rotation can take place when the device is calibrated. Calibration can be necessary since the angular position between the torsion spring's two ends may vary somewhat. When the choke valve lever 21 turns, the slit 27 consequently turns, which turns the torsion spring 9, whose outer end consequently turns the tubular transmission shaft 11, which turns the choke valve plate 5. However, the valve plate 5 is elastically connected with the linkage shaft 7. This means that if the plate is influenced by a force, it can turn itself somewhat in relation to the shaft 7, if the force reaches a certain magnitude. Furthermore, a greater force results in a larger angular deflection from the defined angular position, which the torsion spring gives the valve 5, when no force acts on the valve. A force can act on the valve by means of the air flow which takes place in the carburetor. This force increases with increasing air speed. The torsional stiffness of the spring can be adjusted so that hereby a maximum speed regulating system is obtained, which will be more apparent from FIGS. 9–12. However, the force can also stem from a temperature sensitive device 10, for instance a bimetal or a memory metal device. This is then arranged in a way that it acts between the valve 5 and its linkage shaft 7 and results in a force acting on the valve. The force is temperature sensitive and wants to turn the valve from its defined angular position. In the illustrated preferred embodiment, the torsion spring 9 has been designed so that it at the same time serves as a temperature sensitive device 10. It is a so called bimetal spring, i.e. a coil spring wired from bimetal material. Hereby, the spring turns itself at temperature changes and this gives a temperature compensation of the valve function. The spring 9, 10 is at the same time elastic, so that it can compensate for high forces at overspeeding and consequently also can give an overspeed protection. The torsion spring 9 could also be replaced by another spring device, for instance one or several plate springs. These would act between the valve 5 and its linkage shaft 7. A plate spring could for instance be mounted in the linkage shaft 7 and act on the throttle valve plate 5, so that this can be turned when influenced by a force. The temperature sensitive device 10 can in the same way consist of a plate spring mounted in this way. Even in this case, the spring device and the temperature sensitive device can be combined. The spring device 9 could even consist of a torsionally elastic bushing, e.g. made of rubber. A locking pin 25 is inserted into the linkage shaft 7 and acts in a cut in the carburetor housing 12. The locking pin is mainly intended for giving axial control of the linkage shaft, so that this does not move from forces stemming from the return spring 24. The cut for the locking pin suitably ends in the parting plane, which usually is embodied at the choke valve. During assembly, the choke valve 5 with its sleeve part 19 are located in the inlet section and the tubular transmission shaft 11 is inserted into and fastened inside the sleeve part 19. The linkage shaft 7 is subsequently inserted and its slit 27 is brought into engagement with the end of the torsion spring 9. For the sake of calibration, the tubular transmission shaft can be turned inside the sleeve part 19. An end plug 26 prevents dirt from entering and possibly lubricant from leaking out.

Figure 3:
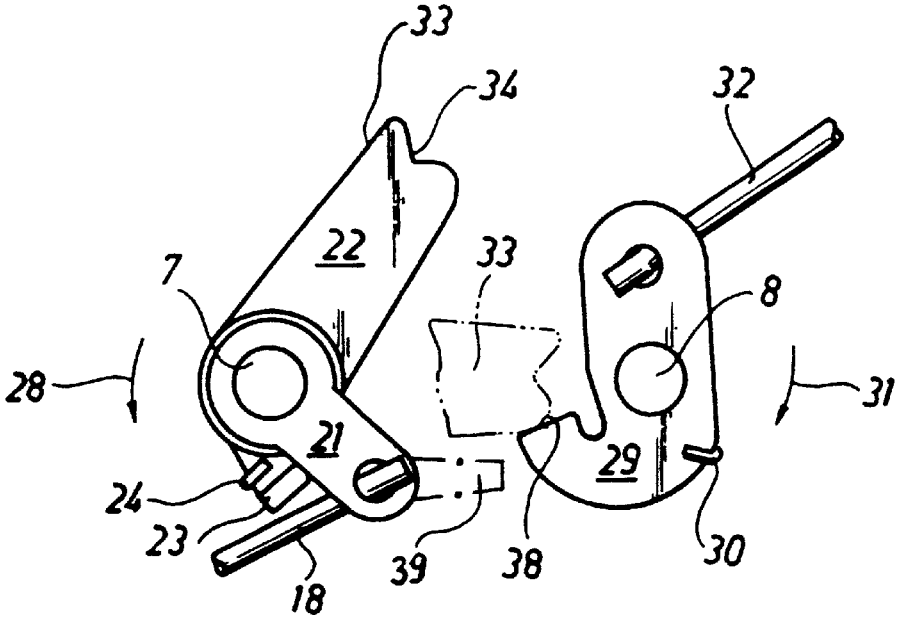
FIG. 3 shows schematically the position of choke valve levers and throttle valve levers in their non-activated positions.
Figure 4:
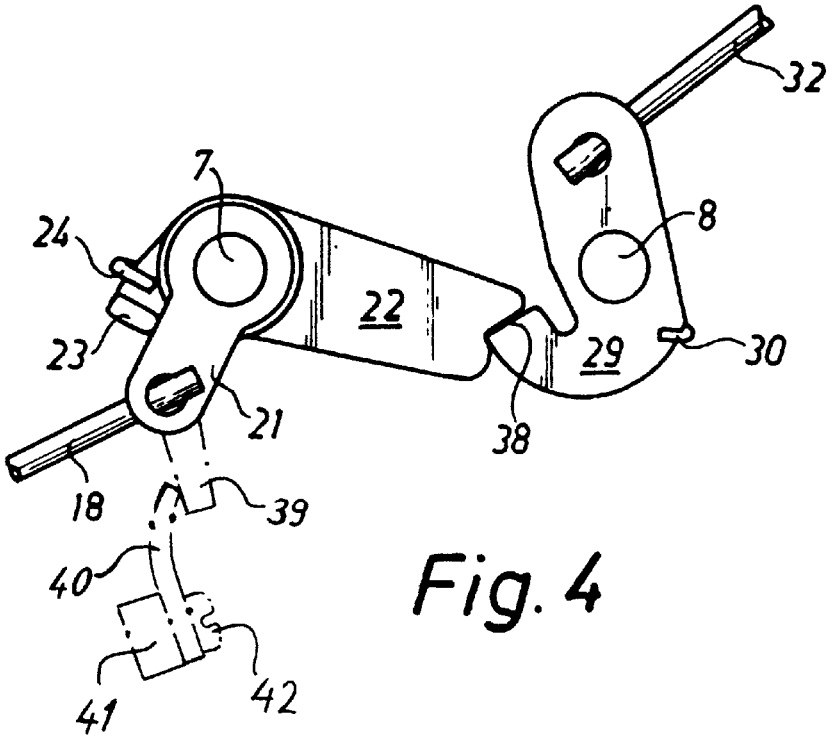
FIG. 4 shows schematically the levers' positions when the engine's starting control is activated and the levers are latched on to each other in a so called starting position.

FIGS. 3 and 4 show a design of the activating levers for the choke and throttle valves, which is not necessary when utilizing the invention, but which is an advantage to utilize. This applies to the case when two valves are used. In those cases when only one valve is used, it is naturally out of the question. As previously mentioned, the linkage shaft 7 for the choke has one choke valve lever 21 and one latch lever 22. The latch lever 22 is influenced by the return spring 24, whose one end can be seen in the figure. The return spring turns the latch lever 22 in a counterclockwise direction in accordance with arrow 28 to the end position, which is shown in the figure. By means of finger 23, which acts on the choke valve lever 21, this is moved to the illustrated end position. In the illustrated position the choke valve is completely open and the linkage rod 18 is in its normal position, i.e. the position it has when the starting control 17 is not activated. The throttle linkage shaft 8 has a rotationally fixed, recessed throttle valve lever 29. A return spring 30 turns, in a way corresponding to the return spring 24, the throttle valve lever 29 in a clockwise direction to the illustrated end position. In the end position the throttle valve is completely closed. A linkage rod 32, which is not shown here, influences the throttle valve lever 29 so that the throttle valve opens when desired. This is consequently the initial position when the engine, a chain saw is not used.

FIG. 4 shows a positioning of the levers when the engine is to be started. When the starting control 17 has been pulled out, the linkage rod 18 has pulled the choke throttle lever 21. This has by means of the finger 23 moved the latch lever 22 in a clockwise direction. The latch lever 22 has an outer end 33 with a notch 34 in it. When the outer end 33 reaches the dash-dotted position, which is shown in FIG. 3, it begins to turn the throttle valve lever 29 in a counterclockwise direction. This continues until a stop 38 in one end of the throttle valve lever wanders passed the tip of the outer end 33 and reaches the notch 34. The motion of the starting control 17 is adapted so that the levers 21, 22 and 29 just reach this desired position, which is illustrated in FIG. 4. In this position full choking has taken place at the same time as a small opening of the throttle valve has occurred. This small opening of the throttle valve corresponds to a desirable starting position. When the engine starts the starting control can be pushed back in. The choke valve lever 21 is hereby turned, while the latch lever 22 is still latched on the throttle valve lever 29. When the operator activates the throttle control, the linkage rod 32 will turn the throttle valve lever 29 counterclockwise, and consequently the latching of the latch lever 22 is released, and this returns to the illustrated position in FIG. 3. The arrangement, which is apparent from FIGS. 3 and 4, has several advantages. Firstly, a suitable starting function appears when the engine is choked, i.e. the starting control 17 is pulled out. In the latched position the linkage rod 18 is not influenced by any force from the return spring 24. The starting control can hereby slowly be pushed in after start. On the other hand, when the throttle is activated the latch lever 22 is released and the starting control is pulled back.

Figure 5:
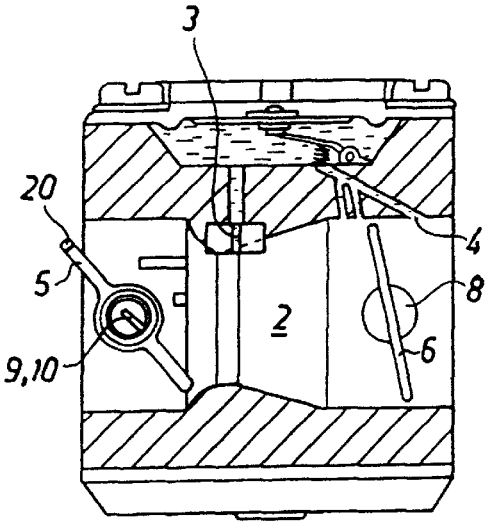
FIG. 5 shows a cross section of the carburetor in FIGS. 1 and 2, seen from the side. The choke and throttles valves are shown in a starting position at approximately +20 degrees C.
Figure 6:
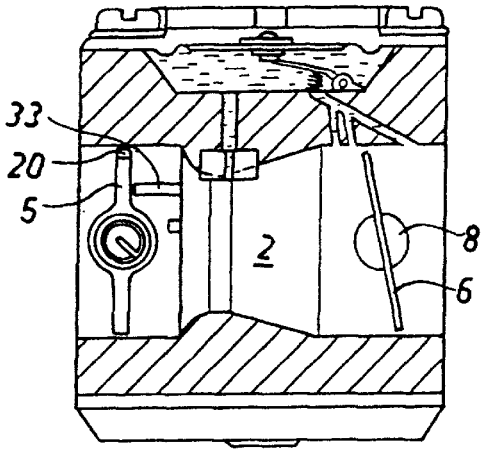
FIG. 6 shows the corresponding illustration, but with the carburetor in a starting position at approximately −20 degrees C.

FIGS. 5–8 show examples of how a temperature compensated choke valve 5 functions under various conditions. FIG. 5 shows the choke and throttle valves in a starting position at approximately +20 degrees C. The throttle valve 6 is somewhat turned in order to give a desirable starting function. This has suitably taken place in accordance with what is illustrated in FIG. 4. The choke valve 5 has due to the high temperature opened a great deal. This will be clearly apparent from a comparison with FIG. 6, which shows a starting position at approximately −20 degrees C. At this low temperature the choke valve is completely closed and air can only pass the choke valve through the opening 20. This results in an extremely rich mixture, which is desirable, at this low temperature. However, this mixture would be far too rich at +20 degrees C., according to FIG. 5. In this case however, the temperature sensitive device 10 has turned the choke valve 5 in relation to its linkage shaft 7. Hereby the engine starts more easily at +20 degrees C. according to FIG. 5 and the risk of it stopping immediately after start has been considerably lessened. Naturally, the exhaust emissions also decrease during start. The two temperature examples illustrate two extreme cases. However, the temperature sensitive device 10, in this case a torsion spring 9 of a bimetal type, acts entirely continuously so that, at intermediate temperatures, a desirably smaller temperature compensation is given. A stop boss 33 prevents the choke valve 5 from turning too far at low temperatures.

Figure 7:
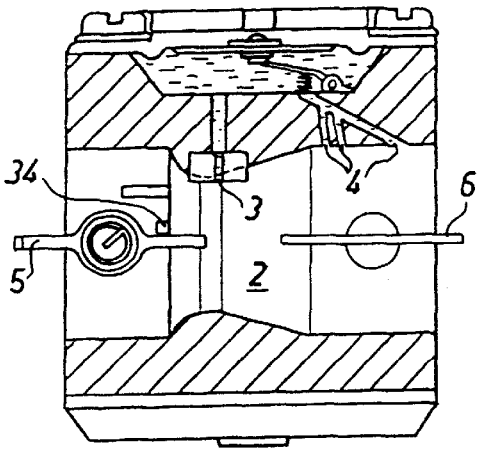
FIG. 7 shows the carburetor in a running position at approximately +20 degrees C. and at full throttle.

FIG. 7 shows the carburetor in a running position at about +20 degrees C. and at wide open throttle. The choke valve is completely open and rests against a stop boss 34 for the running position. This means that even at higher temperatures the choke valve does not turn any further but remains in a completely open position. It is however possible to imagine the stop boss being located so that it permits an overangling of the throttle valve at very high temperatures. The stop boss can even be made elastic. One advantage with overangling at very high temperatures is that the restriction of the air flow in the carburetor reduces the risks for engine seizures.

Figure 8:
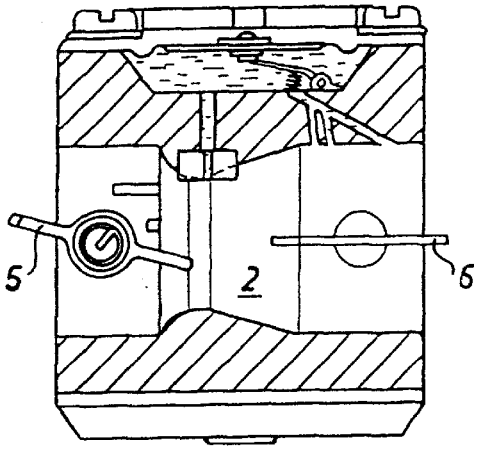
FIG. 8 shows the carburetor in a running position at approximately −20 degrees C. and at full throttle.

FIG. 8 shows the carburetor in a running position at approximately −20 degrees C. and at wide open throttle. As evident from the figure, the choke valve is somewhat rotated due to the low temperature. Thus, this corresponds to a very small choking of the engine and this is desirable considering the very low temperature. Hereby the engine gets a somewhat richer and more suitable running mixture. The valve's temperature compensation is consequently not only an advantage when starting at various temperatures but also during running at various temperatures.

Figure 9:
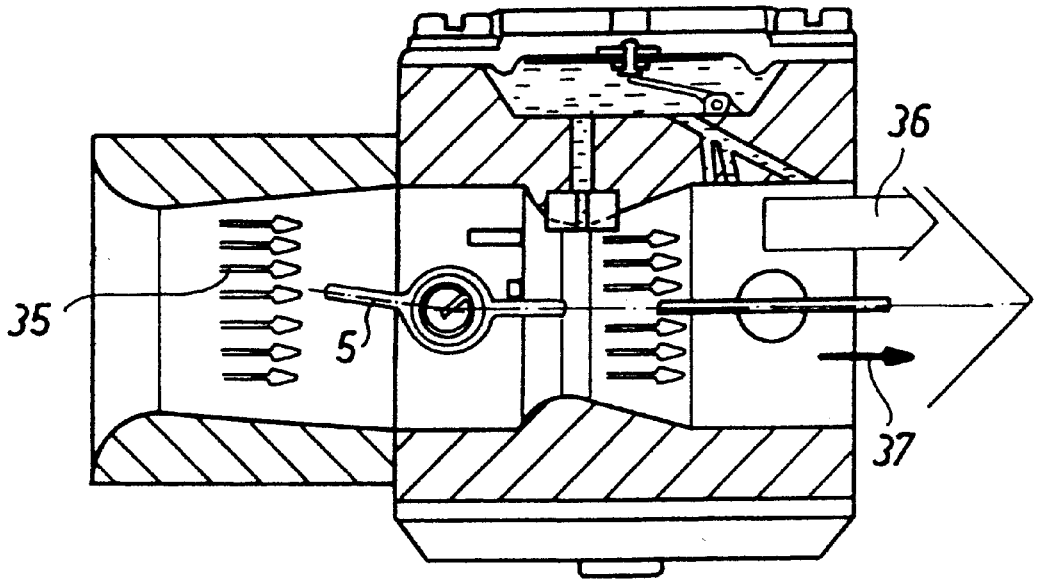
FIG. 9 shows schematically a carburetor, in accordance with the invention, in a full throttle position. The engine has on the whole reached its maximum speed, for instance 10000 revolutions per minute. The inflowing air and fuel are schematically illustrated with arrows.
Figure 10:
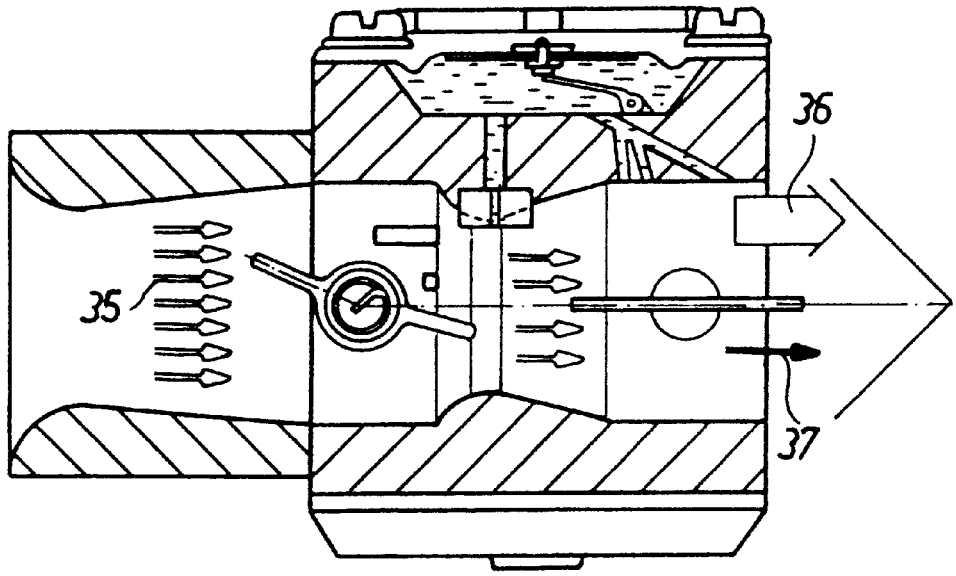
FIG. 10 shows the carburetor schematically at a higher engine speed than in FIG. 9, for instance at about 15000 revolutions per minute. The compensating valve in accordance with the invention has, by means of the acting force from the rapidly passing air, turned itself and resulted in a throttling function, so that the engine speed does not further increase. Thus.

FIGS. 9 and 10 show in what way the compensating valve, in accordance with the invention, can be used in order to limit the engine's maximum speed, i.e. giving an overspeed protection. FIG. 9 shows a running position somewhat below the engine's maximum speed, e.g. 10000 revolutions per minute. The inflowing air is shown schematically with a number of non-filled arrows 35 and the total amount of air is illustrated by a thick non-filled arrow 36. The inflowing amount of fuel is illustrated by a filled arrow 37. The choke valve 5 is in this case somewhat modified and not entirely symmetrical. Its front half is somewhat angled upwards compared to its rear half. Hereby an underpressure is created on the upper side of the front valve half and overpressure on the underside. These pressures increase with increasing air velocity. By means of a suitable tuning of the upward angling and the stiffness of the spring device 9, a maximum speed regulating function can be obtained. This appears from FIG. 10, where the flow velocity of the air has increased since the speed has increased to approximately 15000 revolutions per minute. The valve has now turned itself upwards, so that it thereby throttles the air supply to the engine. This is illustrated by a shorter flow arrow 36. On the other hand, the fuel flow arrow 37 is almost unchanged, since the amount of fuel is relatively unchanged. Hereby the engine speed does not further increase but is limited to the desired maximum speed.

Figure 11:
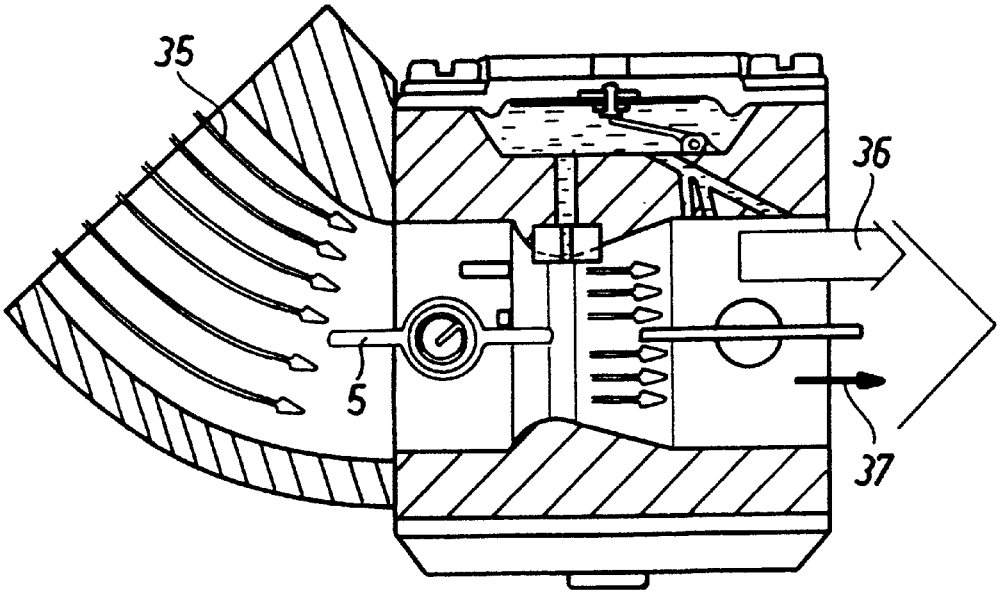
FIG. 11 shows a carburetor with a curved inlet duct and the engine is running close to its maximum speed, as in FIG. 9. The choke valve is symmetrical in this case.
Figure 12:
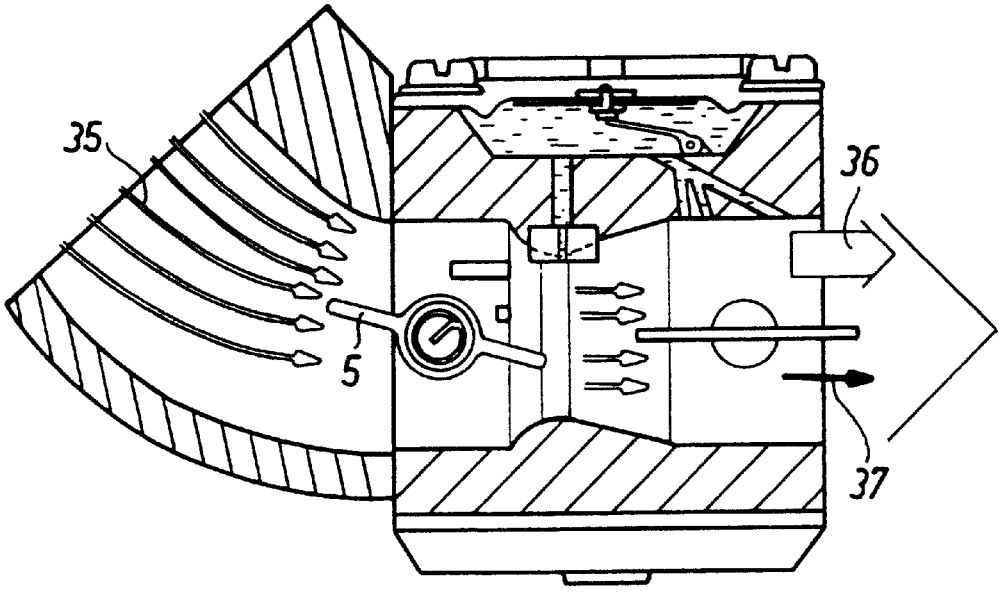
FIG. 12 shows that the obliquely onflowing air has turned the choke valve, so that a throttling function has been obtained. The engine speed has here been stabilized at its maximum, for instance at about 15000 revolutions per minute.

FIGS. 11 and 12 show in what way the overspeed regulating function has been embodied when the carburetor has a curved inlet duct. In this case the valve 5 is symmetrical. Owing to the flow in the curved inlet duct a force acting on valve 5 is created. At the overspeeding limit the valve starts to turn upwards so that it throttles the air flow through the carburetor into the engine. Hereby overspeeding is avoided. The reduced amount of air is made clear by comparing the air flow arrow 36 in FIG. 12 and in FIG. 11. The amount of fuel, in accordance with arrow 37, is approximately constant in both cases.

The embodiment of the invention, which has been described in connection with FIG. 2 and FIGS. 5–12, has several advantages. The air valve 5 is elastically suspended in the rotating direction and hereby a temperature compensation function as well as an overspeed protection function can be embodied in the design. The air valve 5, 6 is kept in a defined angular position in relation to its linkage shaft 7, 8. The linkage shafts are each in turn mechanically connected with manually activated linkages, such as a starting control, choke control linkage or throttle control linkage. This means that in a normal case the choke valve 5 is activated by the starting control and the throttle valve 6 is activated by the throttle linkage. Usually only the choke valve 5 has a temperature compensation. This means that the temperature compensation tunes the valve's angular position, which basically however is manually operated by means of the starting control. This differs completely from the conditions which prevail at a so called automatic choke. In that case, the adjustment of the choke valve is completely automatically operated without manual influence from a throttle control linkage or a starting control. In the present case, the adjustment of the valve's angular position occurs over the entire rotational range of the valve, since the valve is mounted to the temperature sensitive device 10. However, it would also be possible to design a mounting so that influence only occurs at one or both of the end positions in the air valve's direction of rotation. The air valve 5, 6 can in this case be spring-loaded against an end position in the direction of rotation, and this end position could comprise a temperature sensitive device, for instance a bimetal device mounted in a linkage shaft. When the temperature changes the end position also changes. A typical usage of this solution would be in a choke valve 5. At a temperature increase the choke valve's end position is then moved, so that a gap appears around the choke valve and consequently more air would be let in.

This type of correction of the air valve's end positions can also be designed for air valves which are firmly mounted on their linkage shafts in a conventional way. FIGS. 3 and 4 give an example of such a solution, and it is illustrated with dash-dotted lines in the figures, since it constitutes an alternative preferred embodiment. The choke valve lever 21 has been supplied with a protruding nose 39. This nose 39 cooperates with a stop 40, which serves as an end position stop for the choke valve lever 21. The stop 40 is however not fixed but is composed of a temperature sensitive device 40, for instance a bimetal or memory metal device. This is mounted on a protruding boss 41 on the carburetor housing. In the illustrated case, the temperature sensitive device 40 is mounted with a screw 42. Its design and mounting can naturally vary in several ways. Considering production tolerances etc., its position in relation to the choke valve lever 21 can also be adjustable, for instance by means of adjustment washers between the boss 41 and the temperature device 40. This solution can naturally be used with or without the latch lever 22. The latch lever 22 can be supplied with several notches instead of notch 34. The notch 34 is then replaced by a saw teeth like row of notches. The starting function is hereby adapted to different positions of the temperature sensitive device 40, so that the nose 39 extends to the desired position of the temperature sensitive device 40. By means of this design a temperature compensation of the position for full choking is achieved. For, at higher temperatures the device 40 gives the valve 5 a more open or gaping position than at lower temperatures, when the valve is in its closed position. The device 40 can however also be located inside the carburetor housing 12. This could for instance be located so that it forms a stop for the valve plate 5, 6. A bimetal plate spring can be inserted in a duct, which exits close to the valve plate's 5, 6 closed position. At higher temperatures, the plate spring curves and presses on the valve plate 5, 6, so that it lets more air through. The duct is naturally sealed so that no air leaks in through it.

I claim:

1. Fuel supply system (1) for an internal combustion engine arranged in an inlet duct (2), which extends to the engine body itself, which system (1) comprises at least one air valve (5, 6) and at least one nozzle (3, 4) located in connection with said at least one air valve (5, 6), each of said at least one air valve (5, 6) being mounted to a linkage shaft (7, 8), which is rotationally influenced by control linkages (18, 21; 32, 29) connected to manually influenced linkages, wherein said at least one air valve (5, 6) is pivoted around said linkage shaft (7, 8), and at least one spring device (9) is arranged so that it acts between the valve (5, 6) and said linkage shaft (7, 8), and holds the valve (5, 6) in a defined angular position relative to the linkage shaft (7, 8) so that a force of a certain magnitude acting on the valve (5, 6) can turn the valve from the defined angular position and a greater force results in a greater angular rotation to achieve a correction or compensation of the defined angular position adjusted by the manually influenced linkage.

2. Fuel supply system (1) in accordance with claim 1, further comprising a temperature sensitive device (10), said temperature sensitive device being arranged so that it acts between the valve (5, 6) and the linkage shaft (7, 8) and results in a force acting on the valve, said force is temperature sensitive and wants to turn the valve from its defined angular position.

3. Fuel supply system (1) in accordance with claim 2, wherein the temperature sensitive device (10) is elastic and provides a temperature compensation function as well as an elastic function.

4. Fuel supply system (1) in accordance with claim 3, wherein the temperature sensitive device (10) is located in heat-transferring contact with the inlet duct (2) so that the temperature sensitive device is mainly influenced by the temperature of the intake air.

5. Fuel supply system (1) in accordance with claim 4, wherein the temperature sensitive device (10) is composed of a bimetal spring having one end that is rotationally firmly connected with the linkage shaft (7, 8) of the valve and another end that is rotationally firmly connected with the valve, either directly or via an intermediate device (11).

6. Fuel supply system (1) in accordance with claim 5, wherein the intermediate device (11) is composed of a tubular transmission shaft (11), which is pivotally mounted to the valve (5, 6) for the purpose of calibration, but is unpivotable or stiffly pivotable during normal usage of the engine.

7. Fuel supply system (1) in accordance with any one of the preceding claims, wherein the system has two air valves (5, 6), one choke valve (5) and one throttle valve (6) and the choke control linkage shaft (7) has one pivotally mounted choke valve lever (21) as well as one pivotally mounted latch lever (22), which is supplied with a finger (23), which can bring the choke valve lever (21) in a direction towards the opening position of the choke valve (5), and a pretensioned return spring is mounted so that it turns the latch lever (22) and thereby also the choke valve lever (21) to an opening of the choke valve, and a turning of the choke valve lever (21) from an opened position also turns the latch lever (22), whose outer end (33) thereby cooperates with the throttle valve lever (29) and turns this from its normally closed position, and the latch lever (22) and the throttle valve lever are supplied with cooperating latch devices (34, 38), so that they lock each other in a position with full choking of the choke valve (5) and an adapted starting function of the throttle valve (6) and the latch devices are composed of a notch (34) in the outer end (33) of the latch lever (22), which cooperates with a stop (38) in one end of the throttle valve lever.

* * * * *